United States Patent [19]

Bailey et al.

[11] Patent Number: 4,826,096

[45] Date of Patent: May 2, 1989

[54] GASKET WRAPPING APPARATUS

[75] Inventors: Paul R. Bailey, Byesville; Glenver M. Wheatley, Cambridge, both of Ohio

[73] Assignee: NCR Corporation, Dayton, Ohio

[21] Appl. No.: 185,615

[22] Filed: Apr. 25, 1988

[51] Int. Cl.[4] ..... B65H 75/22; B65H 75/28; B65H 75/02

[52] U.S. Cl. ..... 242/67.1 R; 242/47; 242/60; 242/74

[58] Field of Search ..... 242/67.1 R, 67.3 R, 242/86, 96, 85, 115, 116, 73, 74, 47, 50, 60, 61

[56] References Cited

U.S. PATENT DOCUMENTS

| | | | |
|---|---|---|---|
| 649,694 | 5/1900 | Hunter . | |
| 1,087,197 | 2/1914 | Sprick . | |
| 1,359,021 | 11/1920 | Blair | 242/60 |
| 1,731,782 | 10/1929 | Johnson | 242/67.1 R |
| 2,902,233 | 9/1959 | McDonough | 242/85 |
| 2,905,408 | 9/1959 | Frate et al. | 242/118.5 |
| 2,987,265 | 6/1961 | Quinones | 242/67.3 R |
| 3,132,822 | 5/1964 | Arthur | 242/68.5 |
| 3,330,498 | 7/1967 | Rucky | 242/86 |
| 3,656,700 | 4/1972 | Gauvin | 242/67.1 |
| 3,934,834 | 1/1976 | Gick et al. | 242/67.1 |
| 4,192,226 | 3/1980 | Agostinelli | 93/1 C |
| 4,352,469 | 10/1982 | Huck | 242/71.8 |
| 4,428,546 | 1/1984 | Weideman | 242/118.5 |
| 4,570,869 | 2/1986 | Tsuji | 242/71.9 |
| 4,762,286 | 8/1988 | Crow | 242/47 |

*Primary Examiner*—Stuart S. Levy
*Assistant Examiner*—Steven M. DuBois
*Attorney, Agent, or Firm*—Wilbert Hawk, Jr.; Albert L. Sessler, Jr.; Richard W. Lavin

[57] ABSTRACT

A gasket wrapping apparatus including a pair of plate members positioned on a crank member rotatably mounted on a support member. The crank member and one of the plate members include slots located therein which are aligned to receive the end of a strip of material positioned between the plate members. Rotation of the crank member coils the strip of material around a hub portion of one of the plate members. Removing the plate member with the hub portion from the crank member enables an adhesive member to be applied to the mounted coiled material facilitating the removal and storage of the coiled material.

6 Claims, 3 Drawing Sheets

2
W
36
42
45
44
38
26
41
40
34
30
32
22
28
2
20
24

GASKET WRAPPING APPARATUS

BACKGROUND OF THE INVENTION

The present invention relates to a method and apparatus for rolling strips of flexible material into a coil and more particularly to an apparatus for rolling a strip of thick material having a predetermined length into a coil which allows the material to be removed and stored in its coiled condition.

In the manufacture of optical scanning mechanisms associated with a check-out counter, the scanner is sealed by a gasket tape mounted between the top surface of the check-out counter and the top plate of the optical scanner to seal out liquids from entering the scanner mechanism during a check-out operation. The strips of gasket tapes are shipped in a coiled condition allowing the gasket to be inserted within the scanner mechanism at the time the scanner mechanism is mounted within the check-out counter. In manually coiling the strips of gasket material, it was found in many instances that the strip would become uncoiled during the coiling operation thus increasing the time required to produce the coiled gasket strips.

Some patents of interest for showing the state of the art for ribbon wrapping mechanisms are U.S. Pat. No. 1,087,197 entitled "Ribbon Device" by W. F. Sprick and U.S. Pat. No. 3,656,700 entitled "Apparatus for Winding, Storing and Distributing Punch Paper Tape" by R. D. Gauvin.

SUMMARY OF THE INVENTION

There is provided an apparatus for coiling a strip of ribbon material comprising a support member, a crank member rotatably mounted in said support member having a first slot extending through one end of the crank member, a first plate member secured to said crank member adjacent the support member and a first plate assembly slidably mounted on the end of said crank member adjacent said first plate member, said plate assembly including a hub member receiving the end of said crank member and having a second slot extending through the hub member and a second plate member secured to said hub member, said hub member being positioned on a said crank member to align said first and second slots and to engage said first plate member forming a third slot between the first and second plate members whereby upon the insertion of the end of a strip of material through said aligned first and second slots having a width equal to the width of the third slot between the first and second plate members, said crank member will engage the end of the strip of material to wrap the strip into a coil around the end of said hub member upon rotation of said crank member.

It is accordingly an object of the present invention to provide an apparatus for wrapping a strip of gasket material into a coil.

Another object of this invention is to provide an apparatus which is manually operated for wrapping various widths of strips of gasket materials into a coil.

It is a further object of this invention to provide a low cost apparatus for wrapping a strip of gasket material into a coil in a fast and efficient manner.

The above and other objects of the present invention will become more apparent when taken in conjunction with the following description and drawings wherein like characters indicate like parts and which drawings form a part of the present specification.

DETAILED DESCRIPTION OF THE PREFERRED EMBODIMENT

Figure 1:
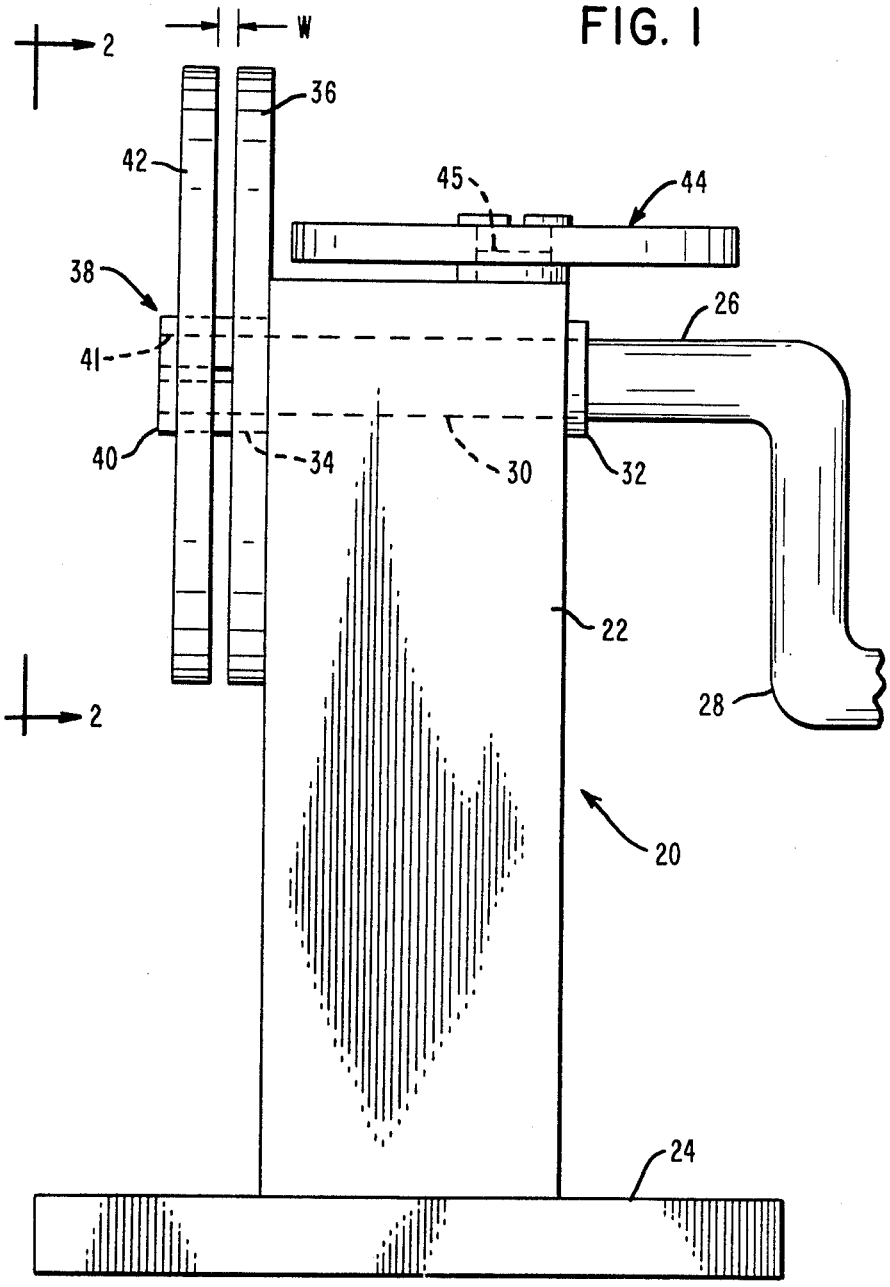
FIG. 1 is a side view of the wrapping apparatus of the present invention.

Referring now to FIG. 1 of the drawings, there is shown a side view of the wrapping apparatus of the present invention generally indicated by the numeral 20 which includes a support member 22 mounted on a base member 24. The support member 22 is fabricated from a solid piece of plastic material such as Teflon, a trademark of the E.I. duPont De Nemours Co. of Wilmington, Delaware. Rotatably mounted within the support member 22 is a crank member 26 which includes a handle portion 28 and a shank portion 30. Press fitted to the shank portion are a pair of bushing members 32 and 34 which engage opposite sides of the support member and act as stop members for positioning the crank member 26 within the support member 22. The bushing members 32 and 34 may be made of a plastic material such as Teflon. Press fitted to the bushing member 34 is a circular plate member 36 (FIGS. 1–4 inclusive) which may be made of a metal such as aluminum.

Slidably mounted on the end 29 (FIG. 3) of the shank portion 30 is a plate assembly generally indicated by the numeral 38 comprising a hub member 40 and a circular plate member 42 press fitted to the hub member 40. The plate member 42 is fabricated from a metal such as aluminum while the hub member may be fabricated from a plastic material such as Teflon. The hub member 40 includes an aperture 41 (FIGS. 2 and 3) within which is slidably positioned the end 29 of the shank portion 30 of the crank handle 26. The hub member has a width which will overhang the inner face 43 of the plate member 42 a distance indicated by the letter "W" in FIG. 1 which represents the width of the strip of gasket material that can be wrapped. Positioning of the plate assembly 38 on the shank portion 30 moves the hub member 40 against the bushing member 34 forming a capture area or slot whose width corresponds to the overhang distance "W" of the hub member 40. Positioned on the support member 40 in any convenient manner such as a hub portion 45 (FIGS. 1 and 3) is a second plate assembly 44 (FIG. 1) which can accommodate a strip of gasket material having a width different from that accommodated by the plate assembly 38. In the present embodiment, the plate assembly 38 will accommodate a gasket strip having a width of 5/16 of an inch while the plate assembly 44 accommodates a strip of material having a width of ⅛ of an inch.

Figure 3:
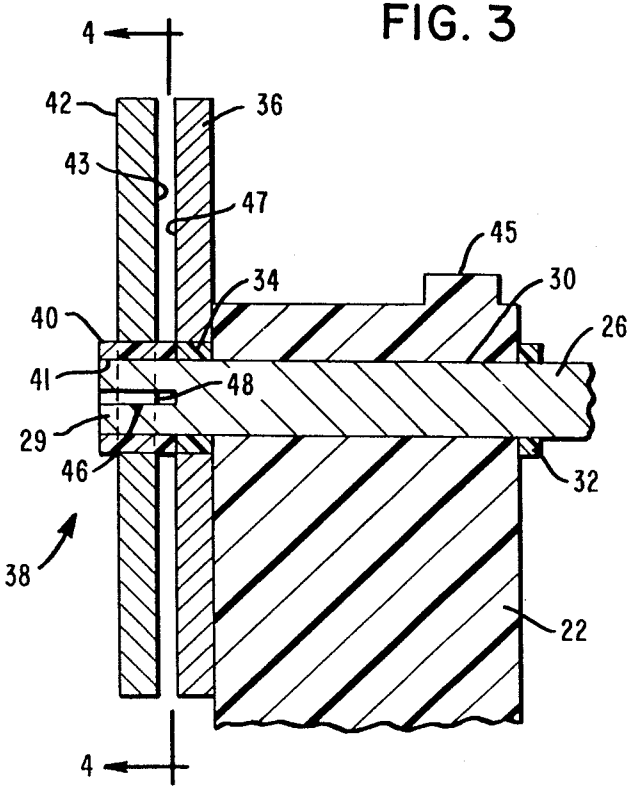
FIG. 3 is a sectional view taken on line 3—3 of FIG. 2 showing details of the mounting of the plate members on the shank portion of the crank handle.
Figure 2:
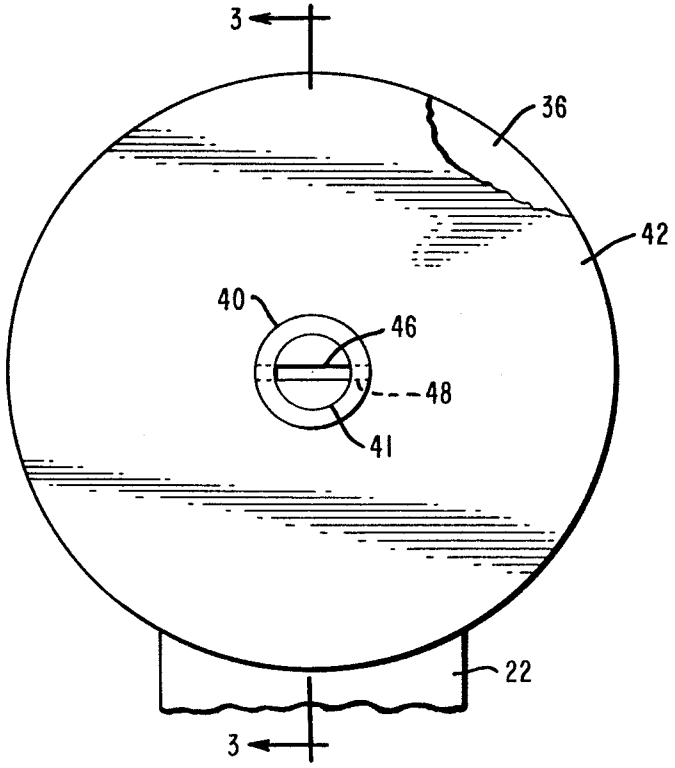
FIG. 2 is a view taken on line 2—2 of FIG. 1 showing the aligned slots.
Figure 4:
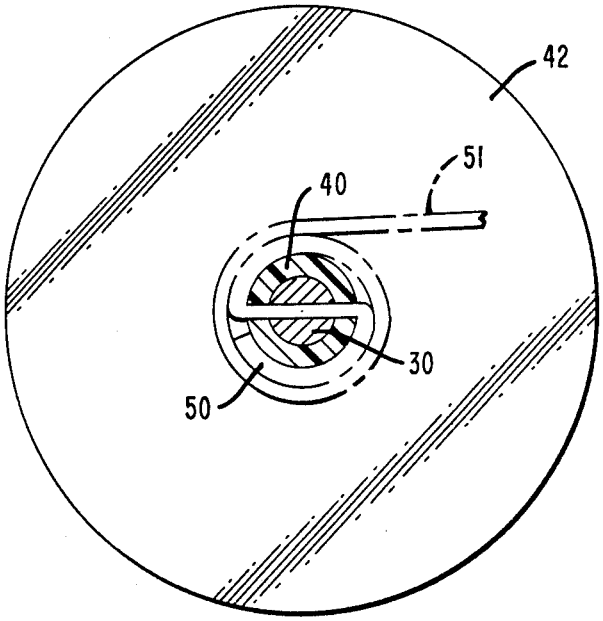
FIG. 4 is a sectional view taken on line 4—4 of FIG. 3 showing details of the strip of gasket material mounted within the slots located within the hub member of the plate assembly and the shank portion of the crank handle.

As best seen in FIGS. 2 and 3, located within the end 29 of the shank portion 30 of the crank member 26 is a slot 46 extending across a diameter of the shank portion 30. The slot 46 extends from the end of the shank portion 30 to a point adjacent the inner face 47 of the plate member 36. Coacting with the slot 46 in engaging the strip of material is a slot 48 extending across the diameter of the hub member 40 and located in the right-end portion of the hub member as viewed in FIG. 3.

Figure 5:
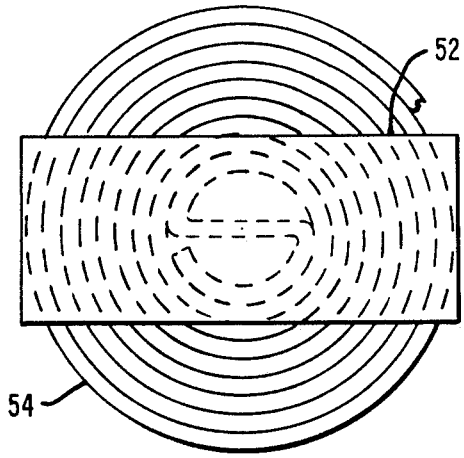
FIG. 5 is a plan view of the strip of gasket material when in a coiled condition after removal from the hub member of the plate assembly.

In the operation of the wrapping apparatus 20, the appropriate plate assembly 38 or 44 (FIG. 1) is slidably mounted on the end 29 of the shank portion 30 of the crank handle 26 until the end of the hub member 40 is positioned against the bushing member 34. The slots 46 and 48 are then aligned and one end 50 (FIG. 4) of the strip 51 of gasket material is inserted through the aligned slots. Rotation of the crank handle 26 in a counterclockwise direction as viewed in FIG. 4 will pinch the end 50 of the strip between the hub member 40 and the crank portion 30 anchoring the strip as the strip is coiled between the plates 36 and 42 upon further rotation of the crank handle 28. Upon completing the coiling of the strip of gasket material, the plate assembly is removed from the end of the crank portion 30 with the strip in a coiled condition around the end of the hub member 40. An adhesive tape 52 (FIG. 5) is then laid across the coiled strip 54 enabling the strip to be removed from the hub member in one piece.

It will thus be seen that the wrapping apparatus of the present invention provides a very simple way to coil various widths of strips of gasket material without the danger of the coil strip prematurely unwinding during the coiling operation.

While the salient features of the invention have been illustrated and described, it should be readily apparent to those skilled in the art that many changes and modifications can be made in the invention presented without departing from the spirit and true scope of the invention. Accordingly, the present invention should be considered as encompassing all such changes and modifications of the invention that fall within the broad scope of the invention as defined by the appended claims.

What is claimed is:

1. An apparatus for coiling a strip of. material comprising;

a support member;

a crank member rotatably mounted in said support member having a first slot extending through one end of the crank member;

a first plate assembly secured to said crank member adjacent the support member, said plate assembly including a first bushing member secured to said crank member and a first plate member secured to said bushing member; and a second plate assembly slidably mounted on the end of said crank member adjacent said first plate assembly, said second plate assembly including a hub member receiving the end of said crank member and having a second slot extending through said hub member and a second plate member secured to said hub member, said hub member being positioned on said crank member to align said first and second slots and to engage said first plate assembly forming a third slot between the first and second plate members whereby upon the insertion of the end of a strip of material through said aligned first and second slots having a width equal to the width of the third slot between the first and second plate members, said crank member will engage the end of the strip of material to wrap the strip into a coil around the end of said hub member upon rotation of said crank member.

2. The apparatus of claim 1 which further includes a third plate assembly slidably mounted on said crank member after the second plate assembly has been removed, said third plate assembly having a second hub member receiving the end of said crank member and a fourth slot extending through said second hub member and a third plate member secured to said second hub member, said second hub member being positioned on said crank member to align said first and fourth slots and to engage said second plate member forming a fifth slot between the first and third plate members having a width different from that of said third slot whereby upon insertion of the end of a strip of material through said aligned first and fourth slots having a width equal to the width of said fifth slot, said crank member will engage the end of the strip of material to wrap the strip into a coil around the end of said second hub member upon rotation of said crank member.

3. The apparatus of claim 1 which further includes a second bushing member spaced apart from said first bushing member and secured to said crank member, said first and second bushing members engaging opposite sides of said support member for limiting the axial movement of the crank member through said support member.

4. The apparatus of claim 2 in which said support member includes a hub portion for supporting said second plate assembly on the support member when not in use.

5. A method for coiling a strip of material comprising the steps of:

mounting a first circular plate member to the slotted end of a crank member;

slidably positioning a second circular plate member having a slotted hub portion on the slotted end of the crank member;

moving the slotted hub portion of the second circular plate member into engagement with the first circular plate member forming a slot there between;

aligning the slots in the slotted end of the crank member and the slotted hub portion;

inserting the end of a strip of material through the aligned slots in the slotted end of the crank member and the slotted hub portion; and rotating the crank member to coil the strip of material around the slotted hub portion.

6. The method of claim 5 which further includes the steps of:

slidably removing the second circular plate member from the slotted end of the crank member with the strip of material coiled around the slotted hub portion;

affixing an adhesive member across the coiled material when coiled around the slotted hub portion for holding the coiled material together; and removing the coiled material from the slotted hub portion of the second circular plate.

* * * * *